US008507169B2

(12) United States Patent
Mine et al.

(10) Patent No.: US 8,507,169 B2
(45) Date of Patent: Aug. 13, 2013

(54) TWO-COMPONENT DEVELOPER

(75) Inventors: Tomoko Mine, Tokyo (JP); Mikihiko Sukeno, Hyogo (JP); Tatsuya Nagase, Tokyo (JP); Tomomi Oshiba, Tokyo (JP); Hiroyuki Kozuru, Yamanashi (JP); Saburou Hiraoka, Tokyo (JP); Yoshiyasu Matsumoto, Tokyo (JP); Kosuke Nakamura, Tokyo (JP); Hitomi Motani, Tokyo (JP); Takanari Kayamori, Kanagawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 43 days.

(21) Appl. No.: 13/406,987

(22) Filed: Feb. 28, 2012

(65) Prior Publication Data

US 2012/0225379 A1 Sep. 6, 2012

(30) Foreign Application Priority Data

Mar. 4, 2011 (JP) ..... 2011-047294

(51) Int. Cl.
*G03G 9/08* (2006.01)

(52) U.S. Cl.
USPC ..... 430/111.35; 430/111.32

(58) Field of Classification Search
USPC ..... 430/111.32, 111.35
See application file for complete search history.

(56) References Cited

U.S. PATENT DOCUMENTS

| | | | | |
|---|---|---|---|---|
| 5,994,015 | A * | 11/1999 | Vail | 430/111.35 |
| 2004/0234876 | A1 * | 11/2004 | Suzuki et al. | 430/97 |
| 2009/0226218 | A1 * | 9/2009 | Takatsuka et al. | 399/252 |

FOREIGN PATENT DOCUMENTS

| | | |
|---|---|---|
| JP | 3691085 | 6/2005 |
| JP | 2009-300531 | 12/2009 |

* cited by examiner

*Primary Examiner* — Hoa V Le
(74) *Attorney, Agent, or Firm* — Lucas & Mercanti, LLP

(57) ABSTRACT

A two-component developer is disclosed, composing a toner comprising parent toner particles with an attached external additive and a carrier provided with a resin covering layer on a surface of a core particle, wherein the resin covering layer comprises a binder resin comprising an acrylic resin and when the resin covering layer is divided in half to a core particle side and a surface side, a nitrogen element content of the core particle side is larger than a nitrogen element content of the surface side.

7 Claims, 2 Drawing Sheets

TWO-COMPONENT DEVELOPER

This application claims priority from Japanese Patent Application No. 2011-047294, filed on Mar. 4, 2011, which is incorporated hereinto by reference.

FIELD OF THE INVENTION

The present invention relates to a two-component developer and a production method of the two-component developer.

BACKGROUND OF THE INVENTION

Recently, electrophotography has been employed in the field of commercial printing and there has been required to be capable of stably supplying images of high quality. To meet such demand, there is required a two-component developer which is difficult to be affected deterioration due to printing or environment variation at the time of printing. In response thereto, there was disclosed a two-component developer, in which an acyclic methacrylate was used for a resin covering layer of a carrier to attain electrostatic charge even under an environment of high temperature and high humidity and to inhibit environmental difference, achieving stabilization of image quality, as described in, for example, JP 3691085 B.

The thus disclosed two-component developer caused a spent phenomenon in which a toner or an external additive adhered to the carrier surface by mechanical stress within a developing device or charge providing capability of a carrier was lowered by abrasion of a resin covering layer, and when performing printing of a large number of sheets, it sometimes became difficult to provide an optimal amount of electrostatic charge to a toner. To overcome such a spent phenomenon, there was applied a technique in which the resin covering layer was caused to be gradually abraded by grinding through mechanical stress such as stirring, whereby the surface layer of the carrier onto which a toner or an external additive adheres was refreshed and electrification capability equivalent to that at the initial stage of printing was maintained.

However, when the resin covering layer become thin by grinding, the electric resistance of the resin covering layer is lessened, rendering it difficult to maintain electrostatic electrification capability and resulting in a lowering of the electrostatic charge, therefore, life of the thus disclosed two-component developer was limited.

There was also disclosed a two-component developer wherein a resin in which a monomer containing a cycloalkyl group was allowed to copolymerize with a nitrogen-containing acrylic monomer (acrylic monomer containing an amino group or its derivatives), was used for a resin covering layer of a carrier, and enhanced electrostatic electrification capability was achieved by introduction of a nitrogen element to the resin covering layer, as described in, for example, JP 2009-300531.

Such a two-component developer has became feasible to maintain high electrostatic charge at the initial stage of printing, however, when performing a large number of prints, abrasion of the resin covering layer results in a lowering of electrostatic charge, so that life of the developer was limited.

SUMMARY OF THE INVENTION

It is an object of the present invention to provide a two-component developer in which electrostatic charge is stably maintained even after conducting a large number of prints and variation in electrostatic charge is minimized even when the printing environment is varied (for example, change from ordinary temperature and humidity to high temperature and high humidity), and which can obtain prints of high density, no fogging and high image quality and is excellent in maintenance property with reduced scattering of a toner within a machine, and a production method of such a two-component developer.

The object of the present invention can be realized by the following constitution.

Namely, one novel aspect of the present invention is directed to a two-component developer composing a toner comprising parent toner particles with an attached external additive and a carrier provided with a resin covering layer on the surface of a core particle, wherein the resin covering layer comprises a binder resin containing an acryl resin and when the resin covering layer is bisected into a core particle side and a surface side, the nitrogen element content of the core particle side is larger than the nitrogen element content of the surface side.

Another aspect of a production method of a two-component developer composing a toner comprising parent toner particles with an attached external additive and a carrier provided with a resin covering layer on the surface of a core particle in which the resin covering layer comprises a binder resin containing an acrylic resin, the method comprises preparing a carrier, preparing a toner, and mixing the carrier and the toner to prepare the developer, wherein the carrier is prepared by a process comprising:

forming a core particle and covering the core particle with a resin to form a resin covering layer on the core particle, while continuously or stepwise varying a nitrogen element content so that the nitrogen element content of the core particle side is larger than the nitrogen element content of the surface side.

In the two-component developer of the present invention and the production method of the same, electrostatic charge can be stably maintained even when conducting a large number of prints and variation in electrostatic charge is minimized even when the printing environment is varied (for example, change from ordinary temperature and humidity to high temperature and high humidity), whereby prints of high density, no fogging and high image quality can be obtained and excellent maintenance property is achieved together with reduced scattering of the toner within a machine.

DETAILED DESCRIPTION OF THE INVENTION

Figure 1A:
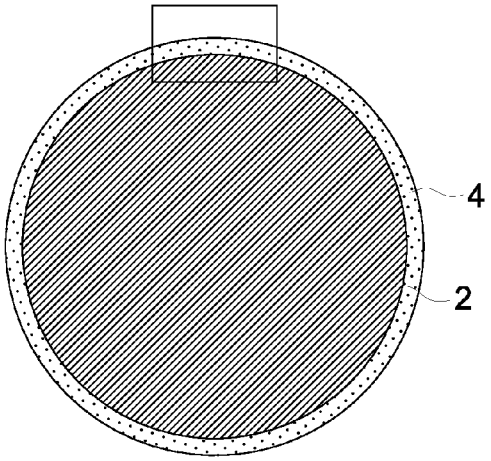
FIG. 1A shows the sectional view of a carrier particle and FIG. 1B shows an enlarged schematic view of the section of the carrier particle.

There was studied by the inventors of the present application a two-component developer which can stably maintain electrostatic charge even when conducting a large number of prints and can minimize variation in electrostatic charge even when the printing environment is varied (for example, change from ordinary temperature and humidity to high temperature and high humidity) to obtain prints of high density, no fogging and high image quality and achieve excellent maintenance property together with reduced scattering of a toner within a machine.

As a result of extensive study to realize the object of the present invention, it was proved that the use of a two-component developer in which a carrier provided with a resin covering layer on the surface of a core particle and the resin covering layer comprises a binder resin containing an acryl resin and when the resin covering layer is bisected into equal parts, that is, a core particle side and a surface side, the content of the nitrogen element of the core particle side is larger than the quantity of the nitrogen element of the surface side, rendered it feasible to minimize variation in electrostatic charge of a toner even when performing printing of a large number of sheets (for example, 500,000 sheets) or when the environment was changed from ordinary temperature and humidity to high temperature and high humidity and also to obtain prints of high density and no fog, and no toner was scattered within then image forming apparatus (within a machine), leading to superior maintenance property.

While the present invention will hereinafter be described in connection with preferred embodiments thereof; it will be understood that it is not intended to limit the invention to those embodiments.

In cases when a two-component developer has been stirred within a developing machine over a long duration, the toner or external additives adhere to the surface of a carrier (which is also called a "spent phenomenon"), resulting in a lowering of electrification performance, leading to a lowering of electrostatic charge of the toner.

Conventionally, a resin covering layer provided on the surface of a core particle was gradually abraded by grinding to refresh the carrier surface onto which a toner or an external additive adheres (said "spent phenomenon"), whereby electrification ability close to the initial stage was maintained. However, when the resin covering layer was abraded to a thickness less than a given value, there was produced such a problem that electric resistance of the resin covering layer decreased, leading to reduced electrification ability, whereby electrostatic charge of a toner is rapidly reduced, rendering it difficult to perform continuous-printing of high image quality.

To overcome such problems that electrostatic charge was rapidly reduced, it was found that the use of a carrier in which the nitrogen element concentration is high on the side near a core particle within a resin covering layer, enabled maintenance of electrification ability equivalent to the initial stage, even when the resin covering layer was abraded.

The carrier used in the present invention has a layer constitution such that a nitrogen element concentration increases as abrasion of a resin covering layer proceeds. Reduction of electrification ability, due to abrasion of a resin covering layer can be recovered by contribution of the nitrogen element within the resin covering layer, rendering it feasible to maintain positive-electrification ability of a carrier. It is assumed that reduction of electrostatic charge does not result, rendering it feasible to attain a stabilized electrostatic charge even when printing a large number of sheets.

It was also proved that in cases when the nitrogen element content of a resin covering layer was increased within the overall layer, the electrostatic charge of the toner excessively increased, making it difficult to obtain prints of a preferable image density.

There will now be described a two-component developer related to the present invention. Two-component Developer:

The two-component developer comprises a toner of a parent toner particle with an attached external additive and a carrier in which a resin covering layer is provided on the surface of a core particle.

The two-component developer of the present invention can be obtained by mixing a carrier and a toner in a mixer. Specific examples of such a mixer include a Henshell mixer (produced by Mitsui Miike Kakoki Co., Ltd.), a Nauta mixer (produced by Powder Tech Co.) and a V-shaped mixer.

A blending ratio of toner to carrier is preferably 3 to 15 parts by mass of a toner, more preferably 4 to 100 parts to 100 parts by mass of a carrier.

Hereinafter, there will be described constituent materials used in the present invention.

Carrier:

A carrier used in the present invention is one in which a resin covering layer is provided on the surface of a core particle, that is, a carrier having a core particle whose surface is covered with a resin layer. A binder resin constituting the resin covering layer contains an acryl resin. It features that, when the resin covering layer is equally divided into the core particle side and the surface side, the amount of nitrogen element content of the core particle side is larger than the nitrogen element contained of the surface side.

Core Particle:

Examples of core particles include iron powder, magnetite, various kinds of ferrite particles and those which are dispersed in resin. Specifically, magnetite or various ferrite particles are preferred. A ferrite containing a heavy metal such as copper, zinc, nickel, manganese or the like, or a light metal ferrite containing an alkali metal and/or alkaline earth metal is preferred.

The volume average diameter of core particles is preferably from 10 to 100 μm, and more preferably, 20 to 80 μm. Core particles having a particle size falling within the foregoing range are suitable to obtain prints of high resolution.

With respect to magnetic characteristics of core particles, a saturated magnetic susceptibility is preferably within a range of $2.5\times10^{-5}$ to $15.0\times10^{-5}$ Wb·m/kg.

The volume average diameter of core particles is a volume-based mean diameter which is determined by a laser diffraction particle size analyzer, HELOS (produced by Sympatec Corp.). the saturated magnetic susceptibility is a value determined by a dc magnetic susceptibility automatic recorder 3257-35 (produced by Yokokawa Denki Co., Ltd.).

Resin for Coverage:

There is employed an acrylic resin as a resin used for formation of a resin covering layer of a carrier.

Examples of an acrylic resin include a polymer of a chain methacrylate monomer, such as methyl methacrylate, ethyl methacrylate, propyl methacrylate, n-butyl methacrylate, hexyl methacrylate, octyl methacrylate or 2-ethylhexyl methacrylate; and a polymer of an acyclic methacrylate monomer having a cycloalkyl ring of 3 to 7 carbon atoms, such as cyclopropyl methacrylate, cyclobutyl methacrylate, cyclopentyl methacrylate, cyclohexyl methacrylate or cyclohexyl methacrylate. Of these, a resin obtained by polymerization of an acyclic methacrylate monomer is preferable which is less variable in electrostatic charge even when a printing environment is varied. Specifically, a polymer of cyclohexyl methacrylate, that is, a poly(cyclohexyl methacrylate) is preferred.

These resins are usable singly or in their combination. For instance, the use of a copolymer of cyclohexyl methacrylate and methyl methacrylate, that is, poly[(cyclohexyl methacrylate)-co-(methyl methacrylate)] easily refreshes the carrier surface and is superior in stress resistance within a developing machine.

There may be used a resin obtained by allowing such an acryl resin to copolymerize with a styrenic monomer such as styrene, a-styrene or p-chlorostyrene.

The weight average molecular weight of a covering resin is preferably from 20, 000 to 1,000,000, and more preferably 30,000 to 700,000. The glass transition temperature (Tg) is preferably from 60 to 180° C., and more preferably 80 to 150° C.

Next, there will be described the nitrogen element content of the resin covering layer.

Figure 1B:
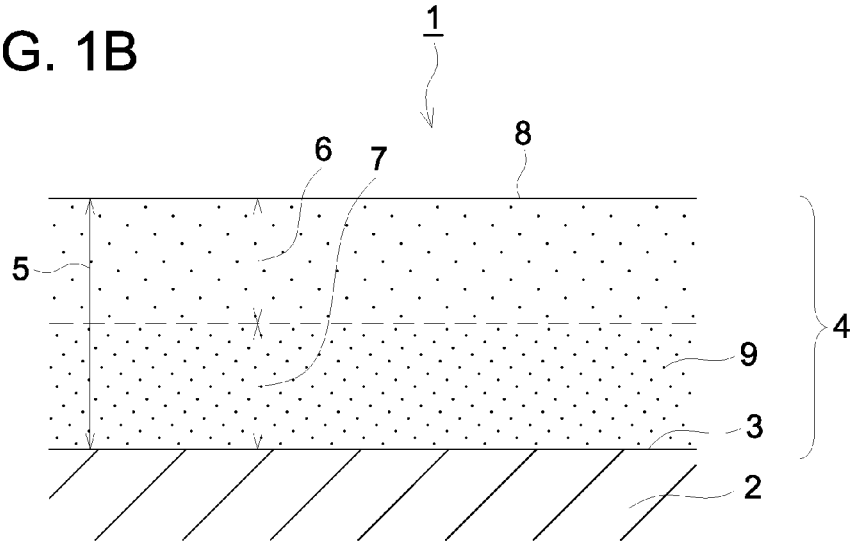

FIG. 1A shows the sectional view of a carrier particle and FIG. 1B shows an enlarged schematic view of the section of the carrier particle.

In FIG. 1, the numeral 1 designates the section of a carrier particle, the numeral 2 designates a core particle, the numeral 3 designates the surface of the core particle, the numeral 4 designates a resin covering layer, the numeral 5 represents a thickness of the resin covering layer, the numeral 6 designates a resin covering layer of the surface side, the numeral 7 designates a resin covering layer of the core particle side, the numeral 8 represents the surface of the resin covering layer and the number 9 represents a nitrogen element.

Nitrogen Element Content of Resin Covering Layer:

A carrier usable in the present invention contains a nitrogen-containing compound in a resin layer. Accordingly, the resin layer contains a nitrogen-containing compound and as a scale of the content of such a nitrogen-containing compound contained in the resin layer are measured nitrogen element contents, which are determined in the manner, as described below.

With respect to a nitrogen element content of a resin covering layer, when the resin covering layer is bisected into a core particle side and a surface side, a nitrogen element content of the core particle side is larger than that of the surface side. The nitrogen element content of the core particle side preferably is 1.10 to 2.00 times larger than that of the surface side.

Determination of Nitrogen Element Content:

The nitrogen element content of a resin covering layer can be determined as below.

A section sample of a carrier particle is prepared through a cross-section polisher method (also denoted as CP method) and photographed by a scanning electron microscope (SEM) at 30,000 fold magnification. In such an obtained electronmicrograph, as shown in FIG. 1B, a resin covering layer (5) is bisected in half at respective portions in the direction of layer thickness. A portion close to a core particle is designated as a resin coating layer (7) of the core particle side and the other one is designated as a resin coating layer (6) of the surface side. Subsequently, in the same visual field, element mapping is conducted by energy dispersive X-ray spectroscopy (also denoted as EDS). At that time, peak separation is appropriately conducted and nitrogen elements are color-coded from other elements. Using an image processor (for example, LUZEX), the thus obtained mapping image and the foregoing SEM imager are superimposed and an are accounted by the nitrogen element (9) is calculated in each of the resin coating layer (7) of the core particle side and the resin coating layer (6) of the surface side. These are each divided by the total area of the resin coating layer (7) of the core particle side, or a total area of the resin coating layer (6) of the surface side, whereby a nitrogen element content of each of the resin coating layer (7) of the core particle side and the resin coating layer (6) of the surface side is calculated. The foregoing measurement is similarly conducted in three photographed visual fields and an average value of the three fields is calculated in each of the core particle side and the surface side, which are designated "nitrogen element content of core particle side" and "nitrogen element content of surface side", respectively. Alternatively, a nitrogen element content can also be determined through mapping concentration of nitrogen element.

Preparation of Carrier:

A carrier is a core particle provided, on its surface, with a resin covering layer. Methods of providing a resin covering layer on the surface of a core particle include a wet coat method and a dry coat method, and the resin covering layer can be provided by any one of these methods. There will be described these methods below.

Wet Coating Method:

(1) Fluidized-Bed Spray Coating Method:

A fluidized-bed spray coating method (which is hereinafter also denoted as a solvent coating method) is a method in which a coating solution of a covering resin dissolved in a solvent is coated on the surfaces of core particles by using a fluid spray coater and then dried to form a resin covering layer.

(2) Dip Coating Method:

A dip coating method is one in which core particles are dipped in a coating solution of a covering resin, dissolved in a solvent to be subjected to a coating treatment and then dried to form a resin covering layer.

(3) Polymerization Method:

A polymerization method is one in which core particles are dipped in and coated with a coating solution of a reactive compound dissolved in a solvent, followed by being subjected to heating to perform polymerization reaction to form a resin covering layer.

Dry Coating Method:

A dry coating method (which is hereinafter also denoted as a mechanochemical method), in which the surfaces of core particles are coated with a covering resin, while applying mechanical impact or heat, forms a resin covering layer by a process comprising the steps of:

1. mechanically stirring a coating material, in which resin particles to be coated and an optional solid material (e.g., resin particles) are dispersed, together with core particles to allow the coating material to adhere to the surfaces of the core particles;

2. applying mechanical impact or heat thereto to cause the resin particles adhered onto the surfaces of the core particles to fuse or be softened to be stuck, thereby forming a resin covering layer; and 3. optionally repeating the foregoing steps 1 and 2 to form a resin covering layer at an intended thickness.

Examples of an apparatus for use in a method of performing coating with applying mechanical impact or heat include a Turbo-mill (produced by Turbo Kogyo Co., Ltd.), a pin mill, a mill provided with a liner and a rotor such as Krypton (produced by Kawasaki Juko Co., Ltd.) and a high-speed stirring mixer provided with stirring blades. Of these, a high-speed stirring mixer installed with stirring blades is preferable which can form an excellent resin covering layer.

Heating is conducted preferably at a temperature of 60 to 125° C. Heating at a temperature within the foregoing range does not cause resin-coated carrier particles to coagulate and can fix a covering resin onto the surface of core particles.

In the present invention, a resin covering layer can be formed by a wet coating method, a dry coating method or a method combining such a wet coating method and a dry coating method. Of these methods, the dry coating method is preferred since ith can easily form a uniform resin covering layer.

Introduction of Nitrogen Element to Resin Covering Layer:

Examples of a method for introducing a nitrogen element to a resin covering layer include the three methods described below.

(1) There is cited the use of a resin obtained by polymerization of a monomer containing a nitrogen element. Such a resin obtained by polymerization of a monomer containing a nitrogen element can be obtained, for example, by copolymerization of an acyclic methacrylic acid ester and a monomer containing a nitrogen element.

Specific examples of a monomer containing a nitrogen element include a nitrogen containing acrylic monomer including an amino group-containing acrylic monomer, such as acrylic acid dimethylamide, methacrylic acid dimethylamide, diethylaminoethyl methacrylate, dimethylaminobutyl methacrylate, diethylaminoethyl methacrylate, dimethylaminobuthyl methacrylate, methylaminoethyl methacrylate, and their derivative; and vinyl pyrrolidone.

There are also cited monomers forming amino resins such as a polyurethane resin, phenol resin, urea-formaldehyde resin (urea resin), melamine resin, benzoguanamine resin or polyamide resin; and a monomer forming an epoxy resin. Of these, a nitrogen-containing acrylic monomer is preferred which renders it easy to maintain the charge providing capacity of a carrier. Further, an amino group containing monomer is more preferred, and dimethylaminoethyl methacrylate is still more preferred. Such a monomer containing a nitrogen element is added preferably in an amount of 0.1 to 20 parts by mass of the whole of a resin covering layer, and more preferably, 0.2 to 10 parts by mass.

(2) There is also cited the use of a polymerization initiator containing a nitrogen element when synthesizing a resin. Namely, a polymerization initiator containing nitrogen element is used in synthesis of a resin to introduce a nitrogen element to the resin structure and allowing it to be disposed at the end of a molecular chain.

As a result of decomposition of such a polymerization initiator containing a nitrogen element, a degradation residue remains as an end group of a polymer chain. The extent of polarization of the end group controls the polarity and charge-providing capacity of a carrier itself.

Specific examples of a polymerization initiator containing a nitrogen element include 2,2'-bis(2-imidazoline-2-yl)[2,2'-azobispropane]dihydrochloride disulfate dehydrate, 2,2'-bis(2-imidazoline-2-yl)[2,2'azobispropane]disulfate dehydrate, 2,2'-azobis-2-amidinopropane dihydrochloride, 2,2'-azobis[N-(2-carboxyethyl)-2-methylpropionamidine], 2,2'-azobis{2-[1-(2-hydroxyethyl)-2-imidazoline-2-yl]propane}dihydrochloride, 2,2'-azobis[2-(2-imidazoline-2-yl)propane], 2,2'-azobis[2-(2-imidazoline-2-yl)propane], 2,2'-azobis(1-imino-1-pyrrolidino-2-methylpropane)dihydrochloride, 2,2'-azobis{2-methyl-N-[1,1-bis(hydroxymethyl)-2-hydroxyethyl]propioneamide}, 2,2'-azobis[N-(2-hydroxyethyl)-2-methylpropaneamide], 2,2'-azobis-(4-methoxy-2,4-dimethylvaleronitrile), 2,2'-azobis(2-methylbutylonitrile),1,1'-azobis(cyclohexane-1-carbonitrile), 2,2'-azobis(2-methyl-n-2-propenylpropaneamide), 1,2-didehydro-1-(1-cyano-1-methylethyl)semicarbazide, 2,2'-azobis(n-butyl-2-methylpropioneamide), and 2,2'-azobis(n-cyclohexyl-2-methylptopioneamide).

Of the foregoing initiators, a compound containing an amino group, as an electron-donating group is preferred in terms of polarity strength. Specific examples of such a compound include 2,2'-azobis-2-amidinopropane dihydrochloride and 2,2'-azobis(1-imino-1-pyrrolidino-2-methylpropane)dihydrochloride are preferred in terms of polarity strength. The addition amount in polymerization reaction preferably is from 0.1 to 10 parts by mass per 100 parts by mass of monomer.

(3) There is also cited, as a method for introducing a nitrogen element to a resin covering layer, addition of a particulate resin containing a nitrogen element to a resin to form the resin covering layer.

Examples of such a particulate resin containing a nitrogen element include melamine-formaldehyde resin particles, polyamide resin particles and melamine-benzoguanamine resin particles. The number average primary particle size of a particulate resin containing a nitrogen element is preferably from 50 to 2000 nm. There is a concern that a number average primary particle size of less than 50 nm possibly deteriorates dispersibility of resin particles in the resin layer and a number average primary particle size of more than 2000 nm easily causes loss of from the resin covering layer, which do not fulfill their original effects.

Of the foregoing (1) to (3), (1) or (3) is preferred which results in highly uniform dispersion on the resin covering layer surface, even when the resin covering layer is abraded, giving rise to stable electrostatic charge.

There will be described a method of allowing nitrogen elements to be localized in the core particle side and the surface side of the resin covering layer. Examples of such a method include one in which a resin covering layer is formed, while varying the amount of a nitrogen element stepwise or continuously.

A resin covering layer in which the nitrogen element content is stepwise varied can be prepared by forming plural resin covering layers in which the kind or the amount of a nitrogen element containing resin is varied.

In the method of forming a resin covering layer while continuously varying the amount of a nitrogen element, a resin containing a nitrogen element and a resin not containing a nitrogen element are prepared. After core particles are added, a resin containing a nitrogen element and a resin not containing a nitrogen element are added thereto, provided that the resin containing a nitrogen element is in a larger amount than the resin not containing a nitrogen element at the start stage of addition; thereafter, the resin containing a nitrogen element and the resin not containing a nitrogen element are further continuously added, while decreasing the addition amount of the resin containing a nitrogen element and increasing an addition amount of the resin not containing a nitrogen element, thereby forming a resin covering layer in which the nitrogen element content of the core particle side is larger than that of the surface side.

Toner:

In the present invention is used a toner obtained by allowing an external additive to be attached to parent toner particles. The thus obtained toner, which results in enhanced flowability when used as a two-component developer, is preferred.

In the present invention, the toner can be prepared by allowing an external additive to be attached to parent toner particles.

Parent toner particles related to the present invention comprise at least a binder resin. A method of producing such parent toner particles is not specifically limited and examples thereof include a grinding method, a suspension polymerization method, a mini-emulsion polymerization coagulation method, a solution suspension method, a polyester molecule elongation method, and other known methods.

There can be employed commonly known resins as a binder resin constituting parent toner particles and specific examples of such resins include a vinyl resin such as a styrene resin, a (meth)acrylic resin, a styrene-(meth)acryl copolymer resin and an olefin resin, a polyamide resin, a polycarbonate resin, a polyether resin, a polyvinyl acetate) resin, a polysulfone, an epoxy resin, polyurethane resin, and a urea resin. These resins may be used singly or in their combination.

Toner particles constituting parent toner particles may contain a colorant. Such a colorant may employ commonly known organic or inorganic colorants. A colorant is contained preferably in an amount of from 1 to 30% by mass of the whole of the parent toner particles, and more preferably from 2 to 20% by mass.

Toner particles constituting parent toner particles may contain a releasing agent. Such a releasing agent may employ various kinds of waxes known in the art. A releasing agent is contained preferably in an amount of from 1 to 30% by mass of the whole of parent toner particles, and more preferably from 5 to 20% by mass.

There may be contained an electrostatic charge controlling agent in parent toner particles. Such an electrostatic charge controlling agent can employ various compounds known in the art.

An external additive is allowed to adhere to parent toner particles to achieve enhanced flowability or cleaning properties of a toner. The kind of an external additive is not specifically limited and examples thereof include inorganic particles, organic particles and a lubricant.

Inorganic particles may employ those which are commonly known and preferred examples thereof include silica, titania, alumina, and strontium titanate particles having a number average primary particle size of 10 to 250 nm. These inorganic particles may be those which have been subjected to a hydrophobilization treatment.

Specific examples of silica particles include R-805, R-976, R-974, R-972, R-812 and R-809 (commercially available from Nippon Aerosil Co., Ltd.); HVK-215 and H-200 (made by Hoechst AG.); and TS-720, TS-530, TS-610, H-5 and MS-5 (commercially available from Cabot Corp.).

Specific examples of titania particles include T-805, and T-604 (commercially available from Nippon Aerosil Co., Ltd.); MT-100B, MT-500BS, MT-600. MT-600SS, and JA-1 (commercially available from TAYCA Co., Ltd.); TA-300S1, TA-500, TAF-130, TAF-510 and TAF-510T (commercially available from FUJI TITANIUM INDUSTRY CO., LTD.); and IT-S, IT-OA, IT-OB and IT-OC (commercially available from Idemitsu Kosan Co., Ltd.).

Specific examples of alumina particles include RFY-C and C-604 (commercially available from Nippon Aerosil Co., Ltd.), and TTO-55 (commercially available from Ishihara Sangyo Co., Ltd.).

Organic particles can employ cubic particles which have a number average primary particle size of approximately 10 to 2000 nm. Preferred examples include a homopolymer of styrene or methyl methacrylate and a their copolymer.

There may be used a lubricant to achieve enhanced cleaning capability or transferability, and examples of such a lubricant include a metal salt of a higher fatty acid. Specific examples include zinc, aluminum, copper, magnesium or calcium salt of stearic acid; zinc, manganese, iron, copper or magnesium salt of oleic acid; zinc, copper, magnesium or calcium salt of palmitic acid; zinc or calcium salt of linoleic acid; zinc or calcium salt of ricinoleic acid.

These external additives or lubricants are added preferably in amount of 0.1 to 10.0% by mass of the total mass of he toner. Addition of an external additive or a lubricant is conducted by using a commonly known mixing devices, such as a tubular mixer, a Henshell mixer, Nauta mixer or V-shape mixer.

An external additive is allowed to adhere to parent toner particles preferably in such a manner that the external additive and parent toner particles are mixed using a mechanical mixer, for example, a Henshell mixer (produced by Mitsui Miike Kakoki Co., Ltd.).

The particle size of a toner preferably is a volume-based median diameter ($D_{50}$) of 3.0 to 8.0 μm. The volume-based median diameter ($D_{50}$) of a toner is a value which is calculated by measuring the volume of a 2.0-60 μm clear toner by using Coulter Multisizer 3 (produced by Beckman Coulter Corp.) at an aperture diameter of 100 μm.

Next, there will be described an image forming method to prepare prints by using a two-component developer and an image forming apparatus.

Image Forming Method:

The two-component developer of the present invention can be used in various electrophotographic image forming methods known in the art, for example, a mono-chromatic image forming method or a full-color image forming method. In the full-color image forming method, there can be employed any of a four-cycle system image forming method constituted of a four-color developing apparatus related to each of yellow, magenta, cyan and black and an electrostatic latent image carrier, and a tandem system image forming method in which image forming units provided with color developing apparatuses and electrostatic latent image carriers related to respective colors are mounted.

Image Forming Apparatus:

The two-component developer of the present invention can be used in a conventional electrophotographic image forming apparatus which comprises at least an electrostatic-charging step of giving rise to a uniform electrostatic potential onto an image carrier, an exposure step of forming an electrostatic latent image on the image carrier in which a uniform electrostatic potential has been given, a development step of developing the electrostatic latent image with a toner to form a toner image, a transfer step of transferring the toner image onto a transfer material, and a fixing step of fixing the toner image onto the transfer material.

EXAMPLES

The present invention will be further described with reference to examples but the embodiments of the present invention are by no means limited to these.

Preparation of Carrier

A carrier was prepared in the manner, as described below.

Preparation of Core Particle:

There were prepared Mn—Mg type ferrite particles exhibiting a volume average diameter of 60 μm and a saturated magnetization of $10.7\times10^{-5}$ W·m/kg.

There were also prepared covering resins used for coverage, as described below.

Preparation of Covering Resin 1:

Into an aqueous 0.3% by mass sodium benzenesulfonate solution were added monomers of cyclohexyl methacrylate/methyl methacrylate/dimethylaminoethyl methacrylate (at a copolymerization ratio 95:4.5:0.5), and further thereto, ammonium peroxodisulfate was added in an amount of 0.5% by mass of the total amount of the monomers to perform emulsion polymerization, whereby covering resin 1 was prepared. The thus obtained covering resin 1 exhibited a weight average molecular weight of 500,000. The weight average molecular weight was determined by using a conventional measurement device.

Preparation of Covering Resin 2:

Covering resin 2 was prepared in the same manner as in preparation of covering resin 1, except that the ratio (copolymerization ratio) of cyclohexyl methacrylate/methyl methacrylate/dimethylaminoethyl methacrylate was changed from (95:4.5:0.5) to (95:4.8:0.2). The thus obtained covering resin 2 exhibited a weight average molecular weight of 480,000.

Preparation of Covering Resin 3:

Covering resin 3 was prepared in the same manner as in preparation of covering resin 1, except that the ratio (copolymerization ratio) of cyclohexyl methacrylate/methyl methacrylate/dimethylaminoethyl methacrylate (95:4.5:0.5) was changed to a ratio of cyclohexyl methacrylate/methyl methacrylate (50:50). The thus obtained covering resin 3 exhibited a weight average molecular weight of 550,000.

Preparation of Covering Resin 4:

Covering resin 4 was prepared in the same manner as in preparation of covering resin 3, except that the ratio of cyclohexyl methacrylate/methyl methacrylate (copolymerization ratio) was changed from (50:50) to (95:5). The thus obtained covering resin 4 exhibited a weight average molecular weight of 530,000.

Preparation of Covering Resin 5:

Covering resin 5 was prepared in the same manner as in preparation of covering resin 1, except that the ratio (copolymerization ratio) of cyclohexyl methacrylate/methyl methacrylate/dimethylaminoethyl methacrylate (95:4.5:0.5) was changed to a ratio of styrene/methyl methacrylate/dimethylaminoethyl methacrylate (95:4.5:0.5). The thus obtained covering resin 3 exhibited a weight average molecular weight of 490,000.

Preparation of Covering Resin 6:

Covering resin 6 was prepared in the same manner as in preparation of covering resin 1, except that the ratio (copolymerization ratio) of cyclohexyl methacrylate/methyl methacrylate (95:4.5:0.5) was changed to a ratio of styrene/methyl methacrylate (50:50). The thus obtained covering resin 6 exhibited a weight average molecular weight of 560,000.

Preparation of Covering Resin 7:

Covering resin 7 was prepared in the same manner as in preparation of covering resin 1, except that the ratio (copolymerization ratio) of cyclohexyl methacrylate/methyl methacrylate (95:4.5:0.5) was changed to a ratio of cyclohexyl methacrylate/methyl methacrylate (95:5) and ammonium peroxodisulfate was replaced by 2,2'-azobis(2-amidinopropane)dihydrochloride. The thus obtained covering resin 7 exhibited a weight average molecular weight of 480,000.

Preparation of Covering Resin 8:

Covering resin 8 was prepared in the same manner as in preparation of covering resin 1, except that the ratio (copolymerization ratio) of cyclohexyl methacrylate/methyl methacrylate (95:4.5:0.5) was changed to a ratio of cyclopropyl methacrylate/methyl methacrylate/dimethylaminoethyl methacrylate (95:4.5:0.5). The thus obtained covering resin 8 exhibited a weight average molecular weight of 430,000.

Preparation of Covering Resin 9:

Covering resin 9 was prepared in the same manner as in preparation of covering resin 1, except that the ratio (copolymerization ratio) of cyclohexyl methacrylate/methyl methacrylate (95:4.5:0.5) was changed to a ratio of cyclopropyl methacrylate/methyl methacrylate (50:50). The thus obtained covering resin 9 exhibited a weight average molecular weight of 450,000.

Preparation of Covering Resin 10:

Covering resin 10 was prepared in the same manner as in preparation of covering resin 1, except that the ratio (copolymerization ratio) of cyclohexyl methacrylate/methyl methacrylate (95:4.5:0.5) was changed to a ratio of cycloheptyl methacrylate/methyl methacrylate/dimethylaminoethyl methacrylate (95:4.5:0.5). The thus obtained covering resin 10 exhibited a weight average molecular weight of 450,000.

Preparation of Covering Resin 11:

Covering resin 11 was prepared in the same mariner as in preparation of covering resin 1, except that the ratio (copolymerization ratio) of cyclohexyl methacrylate/methyl methacrylate (95:4.5:0.5) was changed to a ratio of cycloheptyl methacrylate/methyl methacrylate (50:50). The thus obtained covering resin 11 exhibited a weight average molecular weight of 460,000.

In Table 1 are shown monomers used in preparation of a covering resin, copolymerization ratio, polymerization initiators and the weight average molecular weight of each of the obtained covering resins.

TABLE 1

| Covering Resin | Monomer 1 | Monomer 2 | Monomer 3 | Copolymerization Ratio (1:2:3) | Polymerization Initiator | Weight Average Molecular Weight |
|---|---|---|---|---|---|---|
| 1 | Cyclohexyl methacrylate (CHMA) | Methyl methacrylate (MMA) | Dimethylaminoethyl methacrylate | 95:4.5:0.5 | Ammonium peroxodisulfate (APS) | 500,000 |
| 2 | Cyclohexyl methacrylate (CHMA) | Methyl methacrylate (MMA) | Dimethylaminoethyl methacrylate | 95:4.8:0.2 | Ammonium peroxodisulfate (APS) | 480,000 |
| 3 | Cyclohexyl methacrylate (CHMA) | Methyl methacrylate (MMA) | | 50:50 | Ammonium peroxodisulfate (APS) | 550,000 |
| 4 | Cyclohexyl methacrylate (CHMA) | Methyl methacrylate (MMA) | | 95:5 | Ammonium peroxodisulfate (APS) | 530,000 |
| 5 | Styrene (St) | Methyl methacrylate (MMA) | Dimethylaminoethyl methacrylate | 95:4.5:0.5 | Ammonium peroxodisulfate (APS) | 490,000 |
| 6 | Styrene (St) | Methyl methacrylate (MMA) | | 50:50 | Ammonium peroxodisulfate (APS) | 560,000 |
| 7 | Cyclohexyl methacrylate (CHMA) | Methyl methacrylate (MMA) | | 95:5 | 2,2'-Azobis (2-amidinopropane) dihydrochloride (AAP) | 480,000 |
| 8 | Cyclopropyl methacrylate (CPMA) | Methyl methacrylate (MMA) | Dimethylaminoethyl methacrylate | 95:4.5:0.5 | Ammonium peroxodisulfate (APS) | 430.000 |
| 9 | Cyclopropyl methacrylate (CPMA) | Methyl methacrylate (MMA) | | 50:50 | Ammonium peroxodisulfate (APS) | 450,000 |
| 10 | Cycloheptyl methacrylate (CHPMA) | Methyl methacrylate (MMA) | Dimethylaminoethyl methacrylate | 95:4.5:0.5 | Ammonium peroxodisulfate (APS) | 450,000 |
| 11 | Cycloheptyl methacrylate (CHPMA) | Methyl methacrylate (MMA) | | 50:50 | Ammonium peroxodisulfate (APS) | 460,000 |

Preparation of Carrier 1:

Into a high-speed mixer installed with a stirring blade were added 100 parts by mass of core particles prepared above and 3.5 parts by mass of covering resin 1 and mixed at 22° C. over 15 min., under the condition of a peripheral speed being 8 in/sec, thereafter, mixing was further conducted at 120° C. over 50 min. to form a resin covering layer 1 on the surfaces of the core particles by the action of mechanical impact force (mechanochemical method).

Further, 0.2 parts by mass of the covering resin 3 was added thereto and mixed at 22° C. over 15 min. Then, mixing was further conducted at 120° C. over 50 min. to form a resin covering of the covering layer 3 on the covering layer 1, whereby a dual-layer carrier 1 was prepared. In the resin covering layer of the thus prepared carrier 1, the ratio of nitrogen element content of the surface side to that of the core particle side was proved to be: surface side: core particle side=1.00:1.11.

Preparation of Carrier 2:

A dual-layer carrier 2 was prepared in the same manner as the carrier 1, except that the covering resin 1 was replaced by the covering resin 7. In the resin covering layer of the thus prepared carrier 2, the ratio of nitrogen element content of the surface side to that of the core particle side was proved to be: surface side: core particle side=1.00:1.12.

Preparation of Carrier 3:

Into a high-speed mixer installed with a stirring blade were added 100 parts by mass of core particles prepared above, 2.0 parts by mass of covering resin 4 and 0.5 part of a melamin formaldehyde resin (particle size of 0.1 μm) and mixed at 22° C. over 15 min., under the condition of a peripheral speed being 8 m/sec, thereafter, mixing was further conducted at 120° C. over 50 min. to form a resin covering layer 3 on the surfaces of the core particles by the action of mechanical impact force (mechanochemical method).

Further, 1.0 part by mass of the covering resin 3 was added thereto and mixed at 22° C. over 15 min. Then, mixing was further conducted at 120° C. over 50 min. to form a resin covering of the covering layer 3 on the covering layer 3, whereby a dual-layer carrier 3 was prepared. In the resin covering layer of the thus prepared carrier 3, the ratio of a nitrogen element content of the surface side to that of the core particle side was proved to be: surface side: core particle side=1.00:2.15.

Preparation of Carrier 4:

Into a high-speed mixer installed with a stirring blade were added 100 parts by mass of core particles prepared above and 2.1 parts by mass of covering resin 1 and mixed at 22° C. over 15 min., under the condition of a peripheral speed being 8 m/sec, thereafter, mixing was further conducted at 120° C. over 50 min. to form a resin covering layer 4 on the surfaces of the core particles by the action of mechanical impact force (mechanochemical method).

Further, 1.2 parts by mass of the covering resin 2 was added thereto and mixed at 22° C. over 15 min. Then, mixing was further conducted at 120° C. over 50 min. to form a resin covering layer of the covering layer 2 on the covering layer 4.

Further, 0.2 part by mass of the covering resin 3 was added thereto and mixed at 22° C. over 15 min. Then, mixing was further conducted at 120° C. over 50 min. to form a resin covering layer of the covering resin 3 on the covering layer of the covering resin 2, whereby a three-layered carrier 4 was prepared. In the resin covering layer of the thus prepared carrier 4, the ratio of a nitrogen element content of the surface side to that of the core particle side was proved to be: surface side: core particle side=1.00:1.95.

Preparation of Carrier 5:

First, there were prepared a spray solution 1 in which 50 parts by mass of the covering resin 1 was dissolved in 500 parts by mass of toluene and a spray solution 3 in which 50 parts by mass of the covering resin 3 was dissolved in 200 parts by mass of toluene.

Using a combined fluidized-bed coating apparatus, MP 01-SFP produced by POWREX Co., Ltd. (apparatus of a solvent coat method) and while allowing 1000 parts by mass of the core particles to flow, the spray solution 1 was spray-coated onto the core particle surface over 25 min. under the conditions of a screen mesh of 0.5 mm, at an impeller rotation of 1000 rpm, an exhausting amount of 1.3 $m^3$/min, a coating speed of 9 g/min and a temperature of 65° C. to form a resin covering layer of the covering resin 1.

After being cooled to room temperature, the spray solution 3 was coated over 10 min. to form a resin covering layer of the covering resin 3, whereby a dual-layer carrier 5 was prepared. In the resin covering layer of the thus prepared carrier 5, the ratio of nitrogen element content of the surface side to that of the core particle side was proved to be: surface side: core particle side=1.00:2.26.

Preparation of Carrier 6:

A carrier 6 was prepared in the same manner as the carrier 1, except that the covering resin 1 was replaced by the covering resin 5 and 0.15 part by mass of the covering resin 6 was added in place of addition of 0.2 part by mass of the covering resin 3. In the resin covering layer of the thus prepared carrier 6, the ratio of nitrogen element content of the surface side to that of the core particle side was proved to be: surface side: core particle side=1.00:1.09.

Preparation of Carrier 7:

A carrier 7 was prepared in the same manner as the carrier 1, except that 3.5 parts by mass of the covering resin 1 was replaced by 2.5 parts by mass of the covering resin 8 and 0.2 part by mass of the covering resin 3 was replaced by 1.0 part by mass of the covering resin 9. In the resin covering layer of the thus prepared carrier 7, the ratio of nitrogen element content of the surface side to that of the core particle side was proved to be: surface side: core particle side=1.00:2.15.

Preparation of Carrier 8:

A carrier 8 was prepared in the same manner as the carrier 1, except that 3.5 parts by mass of the covering resin 1 was replaced by 3.45 parts by mass of the covering resin 10 and 0.2 part by mass of the covering resin 3 was replaced by 0.1 part by mass of the covering resin 11. In the resin covering layer of the thus prepared carrier 8, the ratio of nitrogen element content of the surface side to that of the core particle side was proved to be: surface side: core particle side=1.00:1.06.

Preparation of Carrier 9:

Carrier 9 was prepared in such a manner that 100 parts by mass of core particles prepared above and 3.5 parts by mass of covering resin 1 were added into a high-speed mixer installed with a stirring blade and mixed at 22° C. over 15 min. under the condition of a peripheral speed being 8 m/sec, thereafter, mixing was further conducted at 120° C. over 50 min. to form a resin covering layer 9 of the covering resin 1 on the surfaces of the core particles by the action of mechanical impact force, whereby a carrier 9 was prepared. In the resin covering layer of the thus prepared carrier 9, the ratio of nitrogen element content of the surface side to that of the core particle side was proved to be: surface side: core particle side=1.00:1.00.

Preparation of Carrier 10:

A carrier 10 was prepared in the same manner as the carrier 9, except that the covering resin 1 was replaced by the covering resin 4. In the resin covering layer of the thus prepared carrier 10, it was proved that no nitrogen element was detected in both the surface side and the core particle side.

Preparation of Carrier 11:

A carrier 11 was prepared in the same manner as the carrier 1, except that the covering resin 1 was replaced by the covering resin 4 and the covering resin 3 was replaced by the covering resin 1. In the resin covering layer of the thus prepared carrier 11, the ratio of nitrogen element content of the surface side to that of the core particle side was proved to be: surface side: core particle side=1.00:0.00.

In Table 2 are shown a preparation method of a resin covering layer, constitution and nitrogen element content ratio of the resin covering layer.

TABLE 2

| Carrier No. | Preparation Method of Resin Covering Layer | Constitution of Covering Resin: First Layer From Core Particle Side | Second Layer From Core Particle Side | Third Layer From Core Particle Side | Ratio of Nitrogen Element Content of Surface side: Core Particle side(Ratio being represented by a relative value, based on the nitrogen element content of the surface being 1.00) |
|---|---|---|---|---|---|
| 1 | Mechanochemical method | resin 1 | resin 3 | — | 1.00:1.11 |
| 2 | Mechanochemical method | resin 7 | resin 3 | — | 1.00:1.12 |
| 3 | Mechanochemical method | resin 1 + melamine formaldehyde resin | resin 3 | — | 1.00:2.15 |
| 4 | Mechanochemical method | resin 1 | resin 2 | resin 3 | 1.00:1.95 |
| 5 | Solvent coating method | resin 1 | resin 3 | — | 1.00:2.26 |
| 6 | Mechanochemical method | resin 5 | resin 6 | — | 1.00:1.09 |
| 7 | Mechanochemical method | resin 8 | resin 9 | — | 1.00:2.15 |
| 8 | Mechanochemical method | resin 10 | resin 11 | — | 1.00:1.06 |
| 9 | Mechanochemical method | resin 1 | — | — | 1.00:1.00 |
| 10 | Mechanochemical method | resin 4 | — | — | — |
| 11 | Mechanochemical method | resin 4 | resin 1 | — | 1.00:0 |

In the foregoing, the nitrogen element content ratio was determined in accordance with the method described earlier.

Preparation of Toner

A toner was prepared in the manner as described below.

Preparation of Toner 1:

There were prepared resin particles 1H, as follows. In a reaction vessel fitted with a stirrer, a temperature sensor, a condenser and a nitrogen introducing device, 7.08 parts by mass of sodium dodecylsulfate were dissolved in 3,010 parts by mass of deionized water to prepare an aqueous surfactant solution. Then, the temperature within the reaction vessel was raised to 80° C., while stirring the aqueous surfactant solution at a rate of 230 rpm under a nitrogen gas stream.

Subsequently, a polymerization initiator solution in which 9.2 parts by mass of potassium persulfate (KPS) was dissolved in 200 parts by mass of deionized water was added to the aqueous surfactant solution and the temperature within the reaction vessel was adjusted to 75° C. Further thereto, a mixed solution (a1) of the composition, as described below, was added over 1 hour and stirring was conducted at 75° C. to perform polymerization, whereby a resin particle dispersion (1H) in which resin particles 1H were dispersed, was prepared.

| | |
|---|---|
| Styrene | 69.4 parts by mass |
| n-Butyl acrylate | 28.3 parts by mass |
| Methacrylic acid | 2.3 parts by mass |

There were prepared resin particles 1HM, as follows. Into a flask fitted with a stirrer was added a mixture of the following composition:

| | |
|---|---|
| Styrene | 97.1 parts by mass |
| n-Butyl acrylate | 39.7 parts by mass |
| Methacrylic acid | 3.22 parts by mass |
| n-Octyl 3-mercaptopropionate | 5.6 parts by mass |

Further thereto was added 98.0 parts by mass of pentaerythritol tetrabehenate and mixed with heating at 90° C. to prepare a mixed solution (a2).

Further, in a reaction vessel fitted with a stirrer, a temperature sensor, a condenser and a nitrogen introducing device, 1.6 parts by mass of sodium dodecylsulfate were dissolved in 2,700 parts by mass of deionized water to prepare an aqueous surfactant solution. The thus prepared aqueous surfactant solution was heated to 98° C. and thereto, the foregoing resin particle dispersion (1H) was added in an amount of 28 parts by mass in solid equivalent. Then, the foregoing solution (a2) was added thereto and the mixture was dispersed over 2 hours by using a mechanical dispersing device provided with a circulation path to prepare a dispersion (emulsion).

Subsequently, to the thus prepared emulsion were added a polymerization initiator solution of 5.1 parts by mass of potassium persulfate (KPS) dissolved in 240 parts by mass of deionized water and 750 parts by mass of deionized water to prepare a reaction mixture. The reaction mixture was stirred with heating at 98° C. over 2 hours to perform polymerization, whereby a resin particle dispersion (1HM) was prepared in which resin particles 1HM of a composite structure of the resin particle 1H surface, being covered with a resin, were dispersed.

There were prepared resin particles 1HML, as follows. An initiator solution of 7.4 parts by mass of potassium persulfate (KPS) dissolved in 200 parts by mass of deionized water was added to the foregoing resin particle dispersion (1HM) and adjusted to a temperature of 80° C. Then, a mixture of the following composition was added thereto over 1 hour:

| | |
|---|---|
| Styrene | 277 parts by mass |
| n-Butyl acrylate | 113 parts by mass |
| Methacrylic acid | 9.21 parts by mass |
| n-Octyl 3-mercaptopropionate | 10.4 parts by mass |

After completion of addition, heating and stirring was allowed to continue over 2 hours, while being maintained at 80° C. to perform polymerization. Thereafter, the reaction mixture was cooled to 28° C., whereby a resin particle dispersion (1HML) was prepared in which resin particles 1HML were dispersed, and having a composite structure in which the surfaces of the resin particles 1HML were covered with a resin.

There were prepared resin particles used for shelling (1HML), as follows. In a reaction vessel fitted with a stirrer, a temperature sensor, a condenser and a nitrogen introducing device, 2.0 parts by mass of sodium dodecylsulfate was dissolved in 3,010 parts by mass of deionized water to prepare an aqueous surfactant solution. Then, the temperature within the reaction vessel was raised to 80° C., while stirring the aqueous surfactant solution at a rate of 230 rpm under a nitrogen gas stream.

Further, compounds described below were mixed to prepare a mixed solution a4:

| | |
|---|---|
| Styrene | 544 parts by mass |
| n-Butyl acrylate | 160 parts by mass |
| Methacrylic acid | 96 parts by mass |
| n-Octylmercaptan(NOM) | 20 parts by mass |

Then, a polymerization initiator solution in which 10 parts by mass of potassium persulfate (KPS) were dissolved in 200 parts by mass of deionized water was added to the foregoing surfactant solution and thereto, the foregoing mixed solution a4 was dropwise added over 3 hours. The thus obtained mixture was heated to 80° C., during which stirring and heating was allowed to continue over 1 hour to prepare resin particles used for shell formation.

There was prepared a carbon black dispersion. Specifically, 90 parts by mass of sodium dodecylsulfate was dissolved in 1600 parts by mass of deionized water and 420 parts by mass of carbon black (MOGAL L) was gradually added thereto. Subsequently, dispersion was conducted to prepare a carbon black dispersion. The thus prepared carbon black dispersion was measured with respect to particle size by using an electrophoretic light scattering photometer (ELS, produced by Otsuka Denshi Co., Ltd), of which the mass average diameter was 110 nm.

Core particles were prepared as follows. Into a reaction vessel fitted with a stirrer, a temperature sensor, a condenser and a nitrogen introducing device, components described below were added to prepare a mixture:

| | |
|---|---|
| Core particle dispersion | 450 parts by mass (in solid equivalent) |
| Deionized water | 1100 parts by mass |
| Carbon black dispersion | 100 parts by mass (in solid equivalent) |

After the temperature of the mixture was controlled to 30° C., the pH was controlled to 10.0 with an aqueous 5 mol/l sodium hydroxide solution. While stirring the mixture, an aqueous solution in which 60 parts by mass of magnesium chloride hexahydrate was dissolved in 60 parts by mass of deionized water was added thereto over 10 minutes. After completing the addition, the reaction mixture was allowed to stand for 3 minutes, then, the temperature of the reaction mixture was raised to 90° C. over 60 minutes, and, while maintaining the temperature at 90° C., particles were allowed to grow through aggregation of particles. Particle growth was confirmed, while measuring the sizes of aggregated particles by Multisizer 3 (produced by Beckman Coulter Corp.). When the volume-based median diameter ($D_{50}$) reached 5.5 μm, an aqueous solution in which 40.2 parts by mass of sodium chloride was dissolved in 1000 parts by mass of deionized water was added thereto to terminate particle growth, whereby core particles were formed.

Subsequently, shell formation was conducted as follows. A dispersion of the foregoing core particles in an amount of 550 parts by mass (in solid equivalent) was heated to 90° C. and a dispersion of the foregoing resin particles used for shell formation was added thereto in an amount of 50 parts by mass (in solid equivalent), while stirring. Stirring continued over 1 hour to allow the resin particles used for shell formation to fuse onto the core particle surface. Thereafter was added an aqueous solution in which 40.2 parts by mass of sodium chloride was dissolved in 1000 parts by mass of deionized water. The mixture was heated to 95° C. with stirring and ripened over 20 minutes to complete shell formation, and then cooled to 30° C.

The thus formed parent toner particles were filtered off, washed repeatedly with 35° C. deionized water, and dried in 40° C. hot air to prepare parent toner particles of a structure in which the core surface was covered with a shell.

An external additive was added to the foregoing parent toner particles. Specifically, a hydrophobic silica (exhibiting a number average primary particle size of 12 nm and a hydrophobicity of 68) and a hydrophobic titanium oxide (exhibiting a number average primary particle size of 20 nm and a hydrophobicity of 64) were respectively added in amounts of 1.0% by mass and 1.5% by mass to the parent toner particles. After mixing was carried out by using a Henshell mixer (produced by Mitsui Miike Kakoki Co., Ltd.), coarse particles were removed by using a 45 μm aperture sieve, whereby toner 1 was obtained.

Preparation of Two-Component Toner

Into a V-shaped mixer were placed 100 parts by mass of each of the foregoing carriers 1 to 11 and 6 parts by mass of the toner 1, and mixed over 5 minutes under an environment of ordinary temperature and ordinary pressure to prepare each of two-component developers 1-11.

In Table 2 are shown carriers and a toner used in preparation of each of two-component developers.

TABLE 3

| Two-Component Developer No. | Carrier No. | Toner No. |
|---|---|---|
| 1 | 1 | 1 |
| 2 | 2 | 1 |
| 3 | 3 | 1 |
| 4 | 4 | 1 |
| 5 | 5 | 1 |
| 6 | 6 | 1 |
| 7 | 7 | 1 |
| 8 | 8 | 1 |
| 9 | 9 | 1 |
| 10 | 10 | 1 |
| 11 | 11 | 1 |

Evaluation

There was employed a commercially available copying machine (bizhub PRO C6501, produced by Konica Minolta Business Technologies Inc.) as an evaluation machine for two-component developers. Each of the foregoing two-component developers was loaded and printing of a text image at a print ratio of 5% was conducted on 500,000 sheets of A4-size transfer paper under an environment of ordinary temperature and ordinary humidity (20° C., 55% RH), also denoted as "NN", or high temperature and high humidity (30° C., 80% RH), also denoted as "HH".

Figure 2:
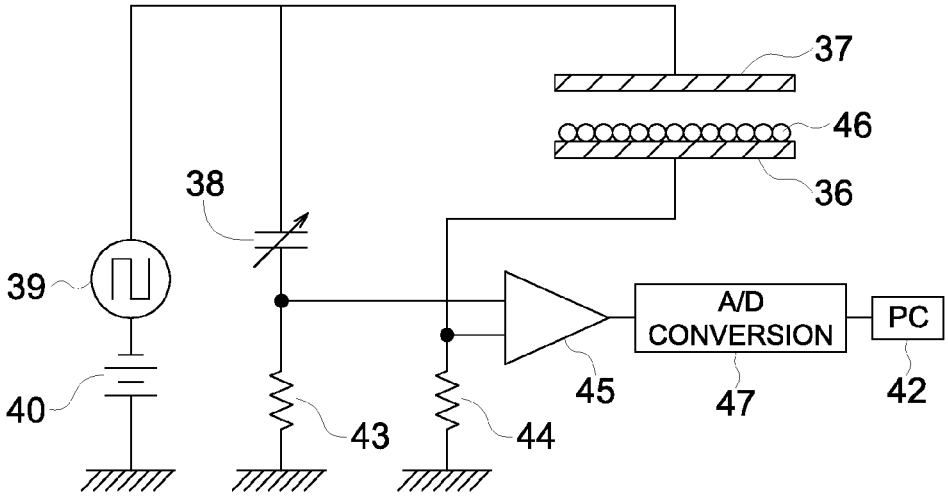
FIG. 2 shows a schematic view of a measuring device of electrostatic charge.

Evaluation of Electrostatic Charge Amount:

The electrostatic charge amount of a two-component was measured by using an electrostatic charge measurement device, as shown in FIG. 2. Measurement was carried our as follows. A two-component developer 46 was placed in an amount of 50 mg between parallel plate (aluminum) electrodes 36 and 37. When the toner was subjected to development under the conditions of a gap between electrodes of 0.5 mm, a DC bias voltage of 1.0 KV, an AC bias voltage of 4.0 KV and 2.0 KHz, an electrostatic charge amount and the mass of a toner supplied to a developing area were measured, from which an electrostatic charge amount per unit mass, Q/m (μC/g) was determined and this value was defined as the electrostatic charge amount. In FIG. 2, the numeral 38 represents a variable capacity condenser, the numerals 39 and 40 represent electric sources, the numeral 47 represents an AID conversion, the numeral 42 represents a personal computer, the numerals 43 and 44 represent resistance, and the numeral 45 represents a buffer.

With respect to the electrostatic charge amount under ordinary temperature and ordinary humidity environment (20° C., 55% RH), a two-component developer was subjected to measurement at the initial stage of printing and after printing of 500, 000 sheets.

With respect to the static charge amount under high temperature and high humidity environment (30° C., 80% RH), the two-component developer was subjected to measurement at the initial stage of printing and after printing of 500,000 sheets.

A static charge amount of a two-component developer which falls within a range of −15 to −70 μC/g, was judged to be acceptable in practice.

An environmental difference in static charge amount of a two-component developer (which is also denoted as "NN—HH") was evaluated based on the criteria below:

A: Less than 25 μC/g (Excellent),

B: Not less than 25 μC/g and less than 30 μC/g (Acceptable in practice),

C: Not less than 30 μC/g (Unacceptable in practice).

Variation of electrostatic charge amount of a two-component developer (that is, between initial stage and after printing of 500,000 sheets) was evaluated based on the following criteria:

A: Less than 10 μC/g under any one of HH environment and NN environment (Excellent), B: Less than 15 μC/g under any one of HH environment and NN environment (Acceptable in practice), C: Not less than 15 μC/g under any one of HH environment and NN environment (Unacceptable in practice).

When a static charge amount falling within the foregoing range was achieved, prints of high density and no fogging were obtained and scattering of toner within a machine was prevented.

Evaluation of Printed Image:

Image Density:

A solid image of 10 cm square was printed at the initial stage of printing and at the stage after printing 500,000 sheets of a character image at a printing ratio of 5%, and its image densities were measured randomly at 10 points by using a reflection densitometer (RD-918, produced by Mcbeth Corp.) and evaluated based on average density. An image density of not less than 1.40, in which an absolute value of an image density difference between initial stage and after printing of 500,000 sheets was not more than 0.10, was judged to be acceptable in practice.

Fogging:

After printing 500,000 sheets of a text image at a print ratio of 5% under a printing environment of ordinary temperature and ordinary humidity, white paper was printed to evaluate a white density of a transfer material. The white density of a transfer material was measured at 20 points on an A-4 size sheet and an average value thereof was defined as the white density. Densitometry was conducted by using a reflection densitometer (RD-918, produced by Mcbeth Corp.).

Evaluation was made based on the following criteria, in which grades A and B were acceptable in practice:

A: A fog density of than 0.003, which is excellent level,

B: A fog density of less than 0.003 and less than 0.010, which is at acceptable level in practice, C: A fog density of not less than 0.010, which is at an unacceptable level in practice.

Scattering of Toner:

After printing 500,000 sheets of white paper under a high temperature and high humidity environment (30° C., 80% RH), the inside of the printing machine was visually observed with respect to scattering of toner particles and evaluation was made based on the following criteria, in which grades A and B were acceptable in practice:

A: A state in which the inside of the machine is not stained with toner particles, B: Slightly scattered toner particles were observed within the machine, C: Markedly scattered toner particles were remarkably observed, and being in a state requiring maintenance of the inside of a machine.

Evaluation results are shown in Tables 4 and 5.

TABLE 4

| Two-Component | Initial Stage | | | | | Stage After printing 500,000 Sheets | | | | | | |
|---|---|---|---|---|---|---|---|---|---|---|---|---|
| | Electrostatic Charge Amount (μC/g) | | Environment Difference (μC/g) | | Solid Image Density | Electrostatic Charge Amountμ (μC/g) | | Environment Differenceμ (μC/g) | | Solid Image Density | | |
| Developer No. | HH*1 | NN*2 | NN − HH | Judge | HH | HH | NN | NN − HH | Judge | HH | Judge | |
| 1 | −33.1 | −56.2 | 23.1 | A | 1.41 | −28.8 | −52.3 | 23.5 | A | 1.43 | acceptable | Example 1 |
| 2 | −32.3 | −55.5 | 23.2 | A | 1.45 | −26.4 | −49.9 | 23.5 | A | 1.48 | acceptable | Example 2 |
| 3 | −34.2 | −57.0 | 22.8 | A | 1.47 | −23.3 | −45.6 | 22.3 | A | 1.53 | acceptable | Example 3 |
| 4 | −32.9 | −56.9 | 24.0 | A | 1.40 | −28.9 | −53.5 | 24.6 | A | 1.42 | acceptable | Example 4 |
| 5 | −28.9 | −49.9 | 21.0 | A | 1.57 | −17.7 | −36.5 | 18.8 | A | 1.63 | acceptable | Example 5 |
| 6 | −24.9 | −54.5 | 29.6 | B | 1.66 | −15.1 | −44.4 | 29.3 | B | 1.71 | acceptable | Example 6 |
| 7 | −30.3 | −60.2 | 29.9 | B | 1.54 | −19.3 | −48.2 | 28.9 | B | 1.60 | acceptable | Example 7 |

TABLE 4-continued

| Two-Component | Initial Stage | | | | | Stage After printing 500,000 Sheets | | | | | | |
|---|---|---|---|---|---|---|---|---|---|---|---|---|
| | Electrostatic Charge Amount (μC/g) | | Environment Difference (μC/g) | | Solid Image Density | Electrostatic Charge Amountμ (μC/g) | | Environment Differenceμ (μC/g) | | Solid Image Density | | |
| Developer No. | HH*1 | NN*2 | NN − HH | Judge | HH | HH | NN | NN − HH | Judge | HH | Judge | |
| 8 | −32.0 | −56.9 | 24.9 | A | 1.56 | −17.7 | −45.4 | 27.7 | B | 1.64 | acceptable | Example 8 |
| 9 | −48.2 | −72.2 | 24.0 | A | 1.38 | −24.9 | −49.8 | 24.9 | A | 1.51 | acceptable | Comp. 1 |
| 10 | −33.9 | −56.6 | 22.7 | A | 1.64 | −12.9 | −35.9 | 23.0 | A | 1.76 | acceptable | Comp. 2 |
| 11 | −47.2 | −71.9 | 24.7 | A | 1.64 | −11.8 | −34.4 | 22.6 | A | 1.81 | acceptable | Comp. 3 |

*1HH: High temperature, high humidity environment (30° C., 80% RH)
*2NN: Ordinary temperature, ordinary humidity environment (20° C., 55% RH)

TABLE 5

| Two-Component | Variation of Electrostatic Charge Amount [(Stage after printing 500,000 Sheets) − (Initial stage)] (μC/g) | | | Evaluation | | | | | |
|---|---|---|---|---|---|---|---|---|---|
| | | | | Difference in Solid Image Density [(Stage after printing 500,000 Sheets) − (Initial stage)] (μC/g) | | Fogging | | Toner Scattering | |
| Developer No. | HH*1 | NN*2 | Judge | HH | Judge | NN | Judge | HH | |
| 1 | 4.3 | 3.9 | A | 0.02 | acceptable | 0.001 | A | A | Example 1 |
| 2 | 5.9 | 5.6 | A | 0.03 | acceptable | 0.002 | A | A | Example 2 |
| 3 | 10.9 | 11.4 | B | 0.06 | acceptable | 0.003 | B | B | Example 3 |
| 4 | 4.0 | 3.4 | A | 0.02 | acceptable | 0.001 | A | A | Example 4 |
| 5 | 11.2 | 13.4 | B | 0.06 | acceptable | 0.007 | B | B | Example 5 |
| 6 | 9.8 | 10.1 | B | 0.05 | acceptable | 0.005 | B | B | Example 6 |
| 7 | 11.0 | 12.0 | B | 0.06 | acceptable | 0.002 | A | B | Example 7 |
| 8 | 14.3 | 11.5 | B | 0.08 | acceptable | 0.004 | B | B | Example 8 |
| 9 | 23.3 | 22.4 | C | 0.13 | unacceptable | 0.002 | A | A | Comp. 1 |
| 10 | 21.0 | 20.7 | C | 0.12 | unacceptable | 0.011 | C | C | Comp. 2 |
| 11 | 35.4 | 37.5 | C | 0.17 | unacceptable | 0.013 | C | C | Comp. 3 |

*1HH: High temperature, high humidity environment (30° C., 80% RH)
*2NN: Ordinary temperature, ordinary humidity environment (20° C., 55% RH)

As shown in Tables 4 and 5, it was proved that, in two-component developers 1-8 of the present invention, an electrostatic charge amount was stably maintained even after printing 500,000 sheets, even when the printing environment was varied, variation of electrostatic charge amount was little, high-quality prints of a constant image density and no fogging were continuously obtained, and no scattering of toner within the machine occurred, whereby advantageous effects of the present invention were achieved. On the contrary, it was proved that in two-component developers 9-11 of comparison, problems arose in any one of the foregoing evaluation items and the advantageous effects of the present invention were not achieved.

What is claimed is:

1. A two-component developer composing a toner comprising parent toner particles with an attached external additive and a carrier provided with a resin covering layer on a surface of a core particle, wherein the resin covering layer comprises a binder resin comprising an acrylic resin and when the resin covering layer is divided in half to a core particle side and a surface side, a nitrogen element content of the core particle side is larger than a nitrogen element content of the surface side.

2. The two-component developer of claim 1, wherein the acrylic resin comprises an alicyclic methacrylate resin.

3. The two-component developer of claim 2, wherein the alicyclic methacrylate resin comprises a poly(cyclohexyl methacrylate).

4. The two-component developer of claim 2, wherein the alicyclic methacrylate resin comprises a poly[(cyclohexyl methacrylate)-co-(methyl methacrylate)].

5. The two-component developer of claim 1, wherein the nitrogen element content of the core particle side is at least 1.05 times larger than the nitrogen element content of the surface side.

6. The two-component developer of claim 1, wherein the carrier is prepared by a process comprising:

forming a core particle and covering the core particle with a resin to form a resin covering layer on the core particle, while continuously or stepwise varying a nitrogen element content so that the nitrogen element content of the core particle side is larger than the nitrogen element content of the surface side.

7. The two-component developer of claim 1, wherein the acrylic resin is a resin obtained by a process of allowing at least an alicyclic methacrylate monomer to polymerize.

* * * * *